US011429049B1

(12) United States Patent
Kodo

(10) Patent No.: US 11,429,049 B1
(45) Date of Patent: Aug. 30, 2022

(54) IMAGE FORMING DEVICE

(71) Applicant: TOSHIBA TEC KABUSHIKI KAISHA, Tokyo (JP)

(72) Inventor: Masahiro Kodo, Izunokuni Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/316,860

(22) Filed: May 11, 2021

(51) Int. Cl.
*G03G 15/00* (2006.01)
*G03G 15/01* (2006.01)
*G03G 15/043* (2006.01)

(52) U.S. Cl.
CPC ..... *G03G 15/5058* (2013.01); *G03G 15/0131* (2013.01); *G03G 15/043* (2013.01); *G03G 15/5041* (2013.01); *G03G 15/55* (2013.01)

(58) Field of Classification Search
CPC ..... G03G 15/5041; G03G 15/5054; G03G 15/5058; G03G 15/5062; G03G 2215/0158; G03G 2215/0161; G03G 15/55; G03G 15/553; G03G 15/556
See application file for complete search history.

(56) References Cited

U.S. PATENT DOCUMENTS 5,287,162 A * 2/1994 de Jong ..... G03G 15/0194 226/29
10,496,005 B1 * 12/2019 Sasaki ..... G03G 15/0849
2003/0142985 A1 * 7/2003 Sampath ..... G03G 15/5062 399/9
2004/0239747 A1 * 12/2004 Maeda ..... G03G 15/0194 347/116
2007/0172264 A1 * 7/2007 An ..... H04N 1/506 399/301
2007/0177912 A1 * 8/2007 Ikeda ..... G03G 15/0131 399/301
2010/0296822 A1 * 11/2010 Takada ..... G03G 15/5058 399/9
2013/0078010 A1 * 3/2013 Inoue ..... G03G 15/0178 399/301
2013/0148996 A1 6/2013 Masui
2013/0155422 A1 * 6/2013 Kuo ..... H04N 1/506 358/1.2

(Continued)

FOREIGN PATENT DOCUMENTS

JP 08286460 11/1996

*Primary Examiner* — Carla J Therrien
(74) *Attorney, Agent, or Firm* — Amin, Turocy & Watson, LLP

(57) ABSTRACT

An image forming device includes a first detection sensor unit that detects a toner image formed on an image carrier; a second detection sensor unit that detects the toner image disposed to be separated in the main scanning direction with respect to the first detection sensor unit and formed on the image carrier; and a controller. The controller causes: an image carrier to carry toner images indicating a first test pattern and a second test pattern, and discriminate a difference from a determination condition with respect to a first determination result based on a first threshold value and a second determination result. The controller determines a component to be an occurrence cause of the difference based on a combination of the first determination result and the second determination result when it is determined that the difference is present.

18 Claims, 13 Drawing Sheets

(56) References Cited

U.S. PATENT DOCUMENTS

| | | | | |
|---|---|---|---|---|
| 2013/0259542 | A1* | 10/2013 | Aviv | G03G 15/0131 399/301 |
| 2017/0123340 | A1* | 5/2017 | Sobue | G03G 15/011 |
| 2019/0129342 | A1* | 5/2019 | Ikeda | G03G 15/556 |
| 2020/0133155 | A1* | 4/2020 | Sasaki | G03G 15/0194 |

* cited by examiner

FIG. 6B

| | | K | C | M | Y |
|---|---|---|---|---|---|
| a | EXPOSURE UNIT | 1 | | | |
| b | PROCESS UNIT | 2 | | | |
| c | TRANSFER BELT UNIT | | | | |
| | | FRONT | | REAR | |
| d | DETECTION SENSOR UNIT | | | | |
| e | OTHER | 3 | | | |

FIG. 7B

| | | K | C | M | Y |
|---|---|---|---|---|---|
| a | EXPOSURE UNIT | | | | |
| b | PROCESS UNIT | | | | |
| c | TRANSFER BELT UNIT | 2 | | | |
| | | FRONT | | REAR | |
| d | DETECTION SENSOR UNIT | | | 1 | |
| e | OTHER | 3 | | | |

FIG. 8B

| | | K | C | M | Y |
|---|---|---|---|---|---|
| a | EXPOSURE UNIT | | | 2 | |
| b | PROCESS UNIT | | | 1 | |
| c | TRANSFER BELT UNIT | | | | |
| | | FRONT | | REAR | |
| d | DETECTION SENSOR UNIT | | | | |
| e | OTHER | 3 | | | |

IMAGE FORMING DEVICE

FIELD

Embodiments described herein relate to an image forming device and methods related thereto.

BACKGROUND

The image forming device includes a plurality of process units, an exposure unit, a transfer mechanism, a fixing device, and the like. The process unit includes a photoconductor and a developing device. The image forming device irradiates a charged and rotating photoconductor with laser beams from an exposure unit based on an image and forms an electrostatic latent image on the photoconductor. The image forming device attaches toners to an electrostatic latent image on the photoconductor with the developing device to form a toner image on the photoconductor. The image forming device transfers the toner image on the photoconductor to a recording medium such as paper with a transfer mechanism. The image forming device fixes the toner image transferred to the recording medium with the fixing device.

It is likely that, in the image forming device, deviation may occur in a position of the toner image transferred from the photoconductor onto the image carrier such as the transfer belt of the transfer mechanism, due to an error in mounting a plurality of process units, manufacturing variation, or a failure in any one of the process units. Therefore, the image forming device has a function of executing the registration control. The image forming device forms a toner image of a test pattern (registration pattern) on the image carrier by registration control and controls timing for irradiating the photoconductor with light from the exposure unit based on the detection result of the test pattern. As described above, the image forming device executes a color shift correction process for controlling the timing for irradiating the photoconductor of each process unit with the laser beams based on the position where the test pattern is formed on the image carrier.

The image forming device forms a test pattern on the image carrier by the registration control and detects the position where the test pattern is generated. The image forming device notifies of error occurrence when a detection result of the test pattern is different from an assumed detection result of the detection when an error does not occur.

The image forming device that notifies of the error occurrence may require a repair. Here, investigation for specifying a portion that is a cause of the error occurrence (a process unit and the like) is required. The work for the investigation requires experience of a worker and takes a long period of time when the worker lacks the experience.

DESCRIPTION OF THE DRAWINGS

FIG. 6B is a diagram illustrating one example of a detection result notified based on the test pattern;

FIG. 7B is a diagram illustrating an example of the detection result notified based on the test pattern;

FIG. 8B is a diagram illustrating an example of the detection result notified based on the test pattern;

DETAILED DESCRIPTION

In general, according to one embodiment, an image forming device includes a photoconductor, an exposure unit, a developing device, a transfer mechanism, a first detection sensor unit, a second detection sensor unit, and a controller. The photoconductor rotates about a main scanning direction as an axis. The exposure unit causes a laser beam to be incident to the photoconductor in the main scanning direction in response to an image and forms an electrostatic latent image on the photoconductor. The developing device causes the toner to be attached to the electrostatic latent image of the photoconductor to form a toner image. The transfer mechanism transfers the toner image on the photoconductor to an image carrier. The first detection sensor unit detects the toner image carried on the image carrier. The second detection sensor unit detects the toner image disposed to be separated in a second direction orthogonal to the first direction with respect to the first detection sensor unit and carried on the image carrier. The controller causes a laser beam to be incident to the first exposure unit in response to a first test pattern and a second test pattern, forms an electrostatic latent image corresponding to the first test pattern and the second test pattern on the first photoconductor, forms a first toner image corresponding to the first test pattern and a second toner image corresponding to the second test pattern by the first developing device, transfers the first toner image and the second toner image of the first photoconductor to the image carrier by the first transfer mechanism, and causes the image carrier to carry the toner images indicating the first test pattern and the second test pattern disposed to be separated from the first test pattern in the main scanning direction. The controller determines a difference from a determination condition with respect to a first determination result based on a first threshold value at a first detection timing by the first detection sensor unit of the first test pattern and a second determination result based on the first threshold value at a second detection timing by the second detection sensor unit of the second test pattern. The controller discriminates a component to be an occurrence cause of the difference based on a combination of the first determination result and the second determination result when it is determined that the difference is present.

Hereinafter, an image forming device according to one embodiment is described with reference to the drawings.

Figure 1:
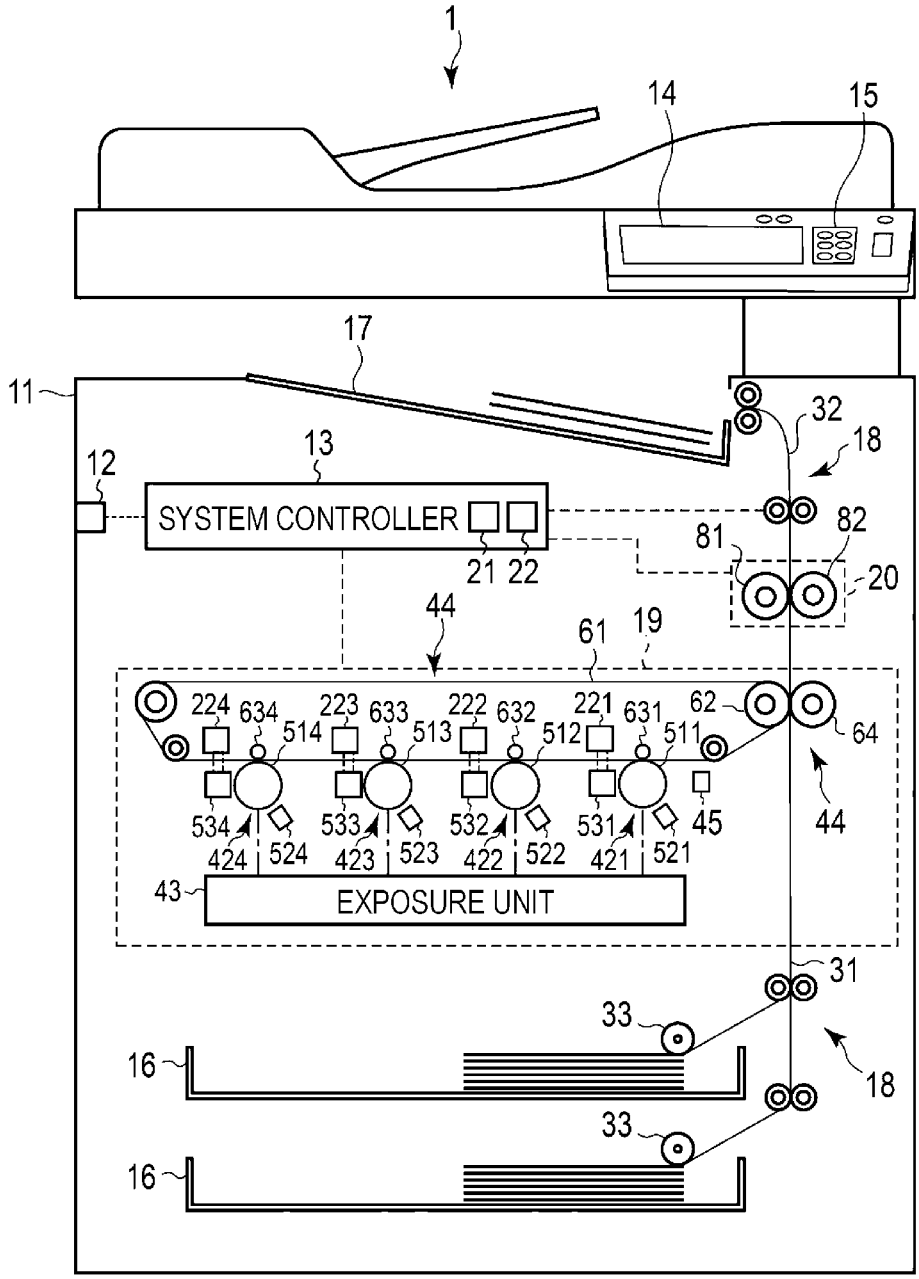
FIG. 1 is a diagram illustrating a configuration example of an image forming device according to an embodiment.

FIG. 1 is an explanatory diagram illustrating a configuration example of an image forming device 1 according to the embodiment.

The image forming device 1 is, for example, a multifunction printer (MFP) that executes various processes such as image forming while a recording medium is conveyed. The image forming device 1 includes a configuration of forming an image to a recording medium by using a toner replenished from a toner cartridge.

For example, the image forming device 1 includes a configuration of receiving toners from toner cartridges 2 and forming an image on a recording medium with the received toner. The image forming device 1 receives toners respectively from the plurality of toner cartridge 2 that hold toners of different colors such as cyan, magenta, yellow, and black and forms a toner image.

As illustrated in FIG. 1, the image forming device 1 include a housing 11, a communication interface 12, a system controller 13, a display unit 14, an operation interface 15, paper feed cassettes 16, a paper ejection tray 17, a conveyance mechanism 18, an image forming unit 19, and a fixing device 20.

The housing 11 is a main body of the image forming device 1. The housing 11 contains, the communication interface 12, the system controller 13, the display unit 14, the operation interface 15, the paper feed cassettes 16, the paper ejection tray 17, the conveyance mechanism 18, the image forming unit 19, and the fixing device 20.

The communication interface 12 is an interface that relays communication with other devices. The communication interface 12 is used, for example, for communication with a client. The client is, for example, an information process device such as a personal computer, a smartphone, or a tablet PC. The communication interface 12 is configured, for example, with a LAN connector. The communication interface 12 may have a configuration of performing wireless communication with a client according to the standards such as Bluetooth (registered trademark) or Wi-fi (registered trademark).

The system controller 13 controls the image forming device 1. The system controller 13 includes, for example, a processor 21 and a memory 22.

The processor 21 is an arithmetic element that executes an arithmetic process. The processor 21 is, for example, a CPU. The processor 21 performs various processes based on data such as a program stored in the memory 22. The processor 21 functions as a control unit that can execute various operations by executing programs stored in the memory 22.

The memory 22 is a storage medium that stores the programs, data used for the program, and the like. The memory 22 functions as a working memory. That is, the memory 22 temporarily stores data being processed by the processor 21 and programs executed by the processor 21.

The processor 21 executes various information processes by executing programs stored in the memory 22. For example, the processor 21 controls transmission and reception of data by the communication interface 12, screen display by the display unit 14, an operation input by the operation interface 15, conveyance of the recording medium by the conveyance mechanism 18, an image forming process by the image forming unit 19, a fixing process by the fixing device 20, and the like. The processor 21 generates a print job based on an image acquired from an external device via the communication interface 12. The processor 21 stores the generated print job in the memory 22.

The print job includes image data indicating an image to be formed on the recording medium. The image data may be data for forming an image on one sheet of recording medium or may be data for forming an image on a plurality of recording media. The print job includes information indicating whether the print is a color print or a monochrome print.

The processor 21 executes a program stored in the memory 22 and functions as a controller (an engine controller) that controls operations of the conveyance mechanism 18, the image forming unit 19, and the fixing device 20. That is, the processor 21 controls the conveyance of the recording medium by the conveyance mechanism 18. The processor 21 controls the forming of the image on the recording medium by the image forming unit 19. The processor 21 controls fixing of an image to the recording medium by the fixing device 20.

The image forming device 1 may have a configuration including an engine controller independently from the system controller 13. For example, the image forming device 1 may include engine controllers respectively corresponding to the conveyance mechanism 18, the image forming unit 19, and the fixing device 20. That is, the image forming device 1 may include an engine controller that controls conveyance of a recording medium by the conveyance mechanism 18, an engine controller that controls the forming of an image on the recording medium by the image forming unit 19, and an engine controller that controls the fixing of the image to the recording medium by the fixing device 20, respectively. Here, the system controller 13 supplies the information required for the control of the engine controller to the engine controller.

The display unit 14 includes a display for displaying a screen in response to an input video signal. For example, screens for various settings of the image forming device 1 are displayed on the display of the display unit 14.

The operation interface 15 includes an operation member that generates an operation signal based on the user's operation.

The paper feed cassette 16 is a cassette that contains a recording medium. The paper feed cassette 16 is configured so that the recording medium can be supplied from the outside of the housing 11. For example, the paper feed cassette 16 is configured to be capable of being extracted from the housing 11.

The paper ejection tray 17 is a tray that supports a recording medium discharged from the image forming device 1.

The conveyance mechanism 18 has a configuration of supplying a recording medium for printing to the image forming unit 19 and discharging the recording medium on which the image is formed by the image forming unit 19 from the housing. For example, the conveyance mechanism 18 includes a paper feed conveyance path 31 and a paper ejection conveyance path 32.

The paper feed conveyance path 31 and the paper ejection conveyance path 32 move the recording medium, respectively.

The paper feed conveyance path 31 takes in the recording medium from the paper feed cassette 16 and supplies the taken recording medium to the image forming unit 19. The paper feed conveyance path 31 includes pickup rollers 33 corresponding to each paper feed cassette 16. Each of the pickup rollers 33 takes the recording media of the paper feed cassettes 16 into the paper feed conveyance path 31.

The paper ejection conveyance path 32 is a conveyance path that discharges the recording medium on which the image is formed from the housing 11. The recording medium discharged by the paper ejection conveyance path 32 is supported by the paper ejection tray 17.

The image forming unit 19 is described.

The image forming unit 19 is a configuration of forming an image on a recording medium. The image forming unit 19 forms an image on the recording medium based on a print job generated by the processor 21.

Figure 2:
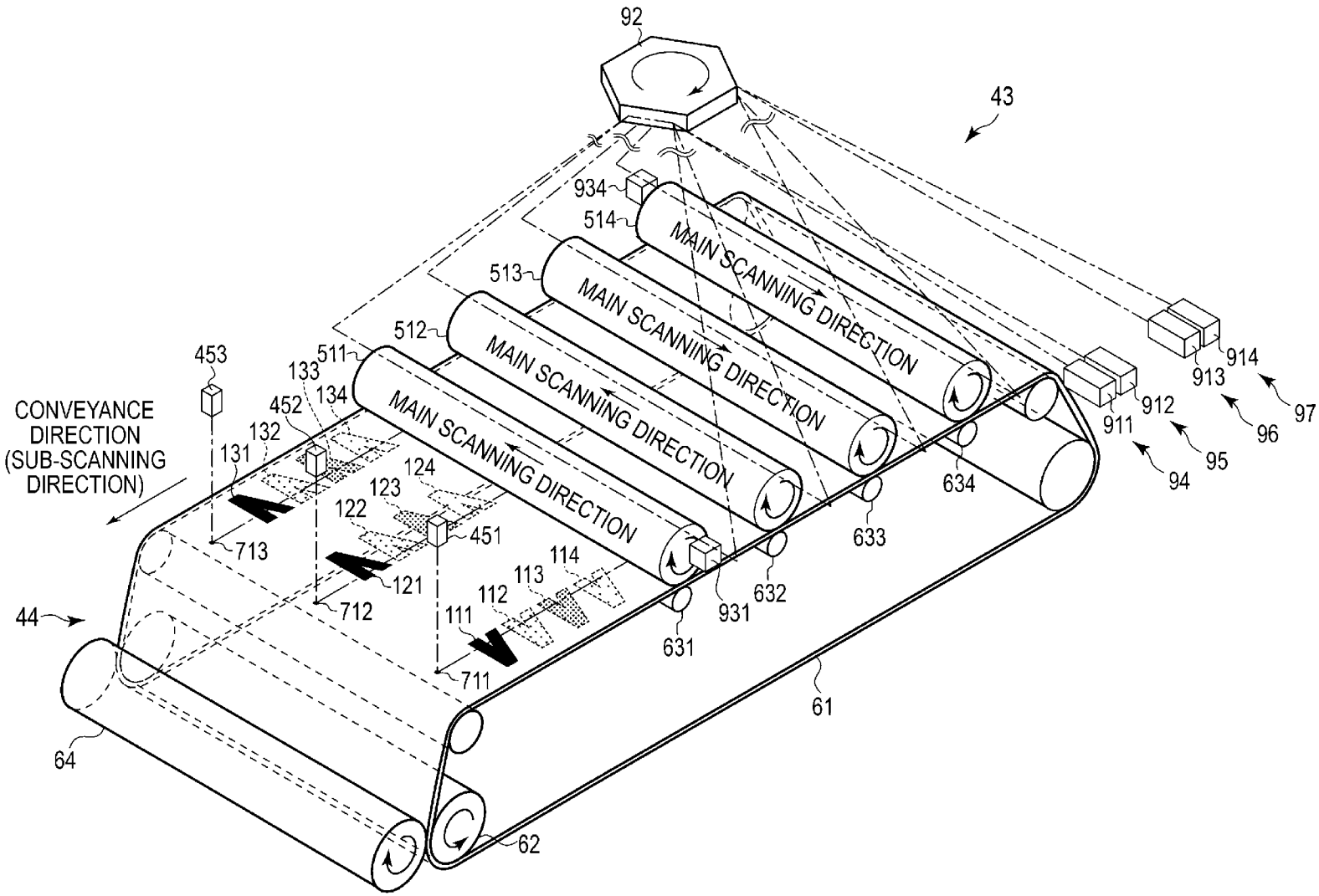
FIG. 2 is a perspective view of a transfer belt unit of the image forming unit seen from an exposure unit and a photosensitive drum side.

The image forming unit 19 includes a plurality of process units 421, 422, 423, and 424, an exposure unit 43, a transfer belt unit 44, a plurality of detection sensor units 45 (detection sensor units 451, 452, and 453 illustrated in FIG. 2). The image forming unit 19 is configured so that toner cartridges 221, 222, 223, and 224 are mounted for the process units 421, 422, 423, and 424, respectively.

The plurality of process units 421, 422, 423, and 424 are described.

The process units 421, 422, 423, and 424 are configurations of forming a toner image. For example, the plurality of process units 421, 422, 423, and 424 are provided for each type of toner. The plurality of process units 421, 422, 423, and 424 correspond to toners of different colors, respectively. The process unit 421 corresponds to a toner of a black color, and the toner cartridge 221 with the toner of the black color is connected thereto. The process unit 422 corresponds to a toner of a cyan color, and the toner cartridge 222 with the toner of the cyan color is connected thereto. The process unit 423 corresponds to a toner of a magenta color, and the toner cartridge 223 with the toner of the magenta color is connected thereto. The process unit 424 corresponds to a toner of a yellow color, and the toner cartridge 224 with the toner of the yellow color is connected thereto.

The process unit 421 includes a photosensitive drum 511, a charging charger 521, and a developing device 531. The process unit 422 includes a photosensitive drum 512, a charging charger 522, and a developing device 532. The process unit 423 includes a photosensitive drum 513, a charging charger 523, and a developing device 533. The process unit 424 includes a photosensitive drum 514, a charging charger 524, and a developing device 534.

The plurality of process units 421, 422, 423, and 424 are the same configuration, and thus the description is made with reference to one process unit 421.

The photosensitive drum 511 is a photoconductor including a cylindrical drum and a photosensitive layer formed on the outer peripheral surface of the drum. The photosensitive drum 511 rotates at a constant speed.

The charging charger 521 uniformly charges the surface of the photosensitive drum 511. For example, the charging charger 521 uniformly charges the photosensitive drum 511 to a potential of the negative polarity by applying a voltage to the photosensitive drum 511.

The developing device 531 is a device that attaches the toner to the photosensitive drum. The developing device 531 includes a developer container, a stirring mechanism, a developing roller, a doctor blade, and the like.

The developer container is a container that receives and contains the toner sent out from the toner cartridge 221. Carriers are contained in the developer container, in advance. The toner sent out from the toner cartridge 221 is stirred with the carrier by a stirring mechanism to configure the developer obtained by mixing the toner and the carrier. The carrier is contained in the developer container when the developing device 531 is manufactured.

The developing roller rotates in the developer container to attach the developer to the surface. The doctor blade is a member that is disposed with a predetermined distance from the surface of the developing roller. The doctor blade removes a portion of the developer attached to the surface of the rotating developing roller. Accordingly, a layer of the developer with the thickness in response to the distance between the doctor blade and the surface of the developing roller is formed on the surface of the developing roller.

The exposure unit 43 is described.

The exposure unit 43 is, for example, an electrophotographic exposure unit using a laser scanning unit (LSU). The exposure unit 43 outputs laser beams in response to the image to be printed and irradiates the charged photosensitive drum 511 of the process unit 421 with the laser beams. The exposure unit 43 deflects the laser beam in the main scanning direction that is a direction parallel to the rotation axis of the photosensitive drum 511. Accordingly, the exposure unit 43 forms an electrostatic latent image for one line on the photosensitive drum 511. The exposure unit 43 continuously irradiates the rotating photosensitive drum 511 with the light and forms electrostatic latent images of a plurality of lines on the photosensitive drum 511. Here, if the layer of the developer formed on the surface of the developing roller of the developing device 531 comes closer to the surface of the photosensitive drum 511, the toner included in the developer is attached to the electrostatic latent image formed on the surface of the photosensitive drum 511. Accordingly, the toner image is formed on the surface of the photosensitive drum 511. Specific configurations of the exposure unit 43 are described below.

The transfer belt unit 44 is described below.

The transfer belt unit 44 is a configuration of transferring the toner images formed on the surfaces of the photosensitive drums 511, 512, 513, and 514 to the recording medium. The transfer belt unit 44 includes, for example, a primary transfer belt 61, a secondary transfer opposing roller 62, a plurality of primary transfer rollers 631, 632, 633, and 634, and a secondary transfer roller 64.

The primary transfer belt 61 is an image carrier to which the toner images formed on the photoconductors (the photosensitive drums 511, 512, 513, and 514) are transferred. The primary transfer belt 61 is an endless belt wound around the secondary transfer opposing roller 62 and a plurality of winding rollers. With respect to the primary transfer belt 61, the inner peripheral surface which is the inner surface thereof comes into contact with the secondary transfer opposing roller 62 and the plurality of winding rollers, and the outer peripheral surface which is the outer surface thereof faces the photosensitive drums 511, 512, 513, and 514 of the process units 421, 422, 423, and 424.

The secondary transfer opposing roller 62 rotates to convey the primary transfer belt 61 in the predetermined conveyance direction. The plurality of winding rollers are configured to be freely rotatable. The plurality of winding rollers rotate according to the movement of the primary transfer belt 61 by the secondary transfer opposing roller 62.

The plurality of primary transfer rollers 631, 632, 633, and 634 cause the primary transfer belt 61 to come into contact with the photosensitive drums 511, 512, 513, and 514 of the process units 421, 422, 423, and 424 corresponding thereto, respectively. The plurality of primary transfer rollers 631, 632, 633, and 634 are provided to correspond to the photosensitive drums 511, 512, 513, and 514 of the process units 421, 422, 423, and 424 corresponding thereto, respectively. For example, a primary transfer roller 631 is provided at a position of facing the photosensitive drum 511 of the process unit 421 with the primary transfer belt 61 sandwiched therebetween. The primary transfer roller 631 comes into contact with the inner peripheral surface side of the primary transfer belt 61 and displaces the primary transfer belt 61 to the photosensitive drum 511 side. Accordingly, the primary transfer roller 631 causes the outer peripheral surface of the primary transfer belt 61 to come into contact with the photosensitive drum 511.

The secondary transfer roller 64 is provided at a position facing the primary transfer belt 61. The secondary transfer roller 64 comes into contact with the outer peripheral surface of the primary transfer belt 61 and applies pressure. Accordingly, a transfer nip at which the secondary transfer roller 64 and the outer peripheral surface of the primary transfer belt 61 are in close contact with each other is formed. When a recording medium passes through the transfer nip, the secondary transfer roller 64 presses the recording medium that passes through the transfer nip to the outer peripheral surface of the primary transfer belt 61.

The secondary transfer roller 64 and the secondary transfer opposing roller 62 rotate to convey the recording medium supplied from the paper feed cassette 16 by a conveyance mechanism 65 in a sandwiched state. Accordingly, the recording medium passes through the transfer nip.

In the above configuration, if the outer peripheral surface of the primary transfer belt 61 comes into contact with the photosensitive drums 511, 512, 513, and 514, the toner images formed on the surfaces of the photosensitive drums 511, 512, 513, and 514 are transferred to the outer peripheral surface of the primary transfer belt 61. If the image forming unit 19 includes the plurality of process units 42, the primary transfer belt 61 receives the toner images from the photosensitive drums 511, 512, 513, and 514 of the plurality of process units 421, 422, 423, and 424. The toner images transferred to the outer peripheral surface of the primary transfer belt 61 are conveyed to the transfer nip where the secondary transfer roller 64 and the outer peripheral surface of the primary transfer belt 61 are in close contact with each other, by the primary transfer belt 61. If the recording medium is present at the transfer nip, the toner images transferred to the outer peripheral surface of the primary transfer belt 61 are transferred to the recording medium at the transfer nip.

The configuration relating to the fixing of the image forming device 1 is described.

The fixing device 20 melts the toner transferred to the recording medium to fix the toner image. The fixing device 20 operates based on the control of the system controller 13. The fixing device 20 includes a heating member that applies heat to the recording medium and a pressurizing member that applies pressure to the recording medium. For example, the heating member is a heat roller 81. For example, the pressurizing member is a press roller 82.

The heat roller 81 is a rotating body for fixing that rotates. The heat roller 81 includes a core metal formed of hollow metal and an elastic layer formed on the outer periphery of the core metal. The heat roller 81 is heated to a high temperature by a heater disposed inside a core metal formed in a hollow shape. The heater is, for example, a halogen heater. The heater may be an induction heating (IH) heater that heats the core metal by electromagnetic induction.

The press roller 82 is provided at the position facing the heat roller 81. The press roller 82 includes a core metal formed of metal having a predetermined outer diameter and an elastic layer formed on the outer periphery of the core metal. The press roller 82 applies pressure to the heat roller 81. The fixing nip at which the press roller 82 and the heat roller 81 are in close contact with each other by applying the pressure from the press roller 82 to the heat roller 81 is formed. The press roller 82 rotates to move the recording medium entering the fixing nip and also presses the recording medium to the heat roller 81.

According to the above configuration, the heat roller 81 and the press roller 82 apply the heat and the pressure to the recording medium that passes through the fixing nip. Accordingly, the toner images are fixed to the recording medium that passes through the fixing nip. The recording medium that passes through the fixing nip is discharged to the outside of the housing 11 by the conveyance mechanism 18. The fixing device 20 is not limited to the above configuration. The fixing device 20 may be configured to be an on-demand method in which heat is applied to the recording medium to which the toner images are transferred via a film-like member so that the toner is melted and fixed.

The plurality of detection sensor units 45 are described.

FIG. 2 is a perspective view of the transfer belt unit 44 of the image forming unit 19 seen from the exposure unit 43 and the photosensitive drums 51 side. An example in which three of the detection sensor units 451, 452, and 453 are provided in the image forming unit 19 as the plurality of detection sensor units 45 is presented.

The detection sensor units 451, 452, and 453 each include a sensor that outputs an electric signal in response to the applied light and an optical system that causes the light to be incident to the sensor. The detection sensor units 451, 452, and 453 convert the light that is incident to the sensor from detection positions 711, 712, and 713 via the optical system into the electric signals and each output the light to the system controller 13.

The detection sensor units 451, 452, and 453 each are disposed to detect the toner image at one different point of the detection positions 711, 712, and 713 on the outer peripheral surface of the primary transfer belt 61. For example, as illustrated in FIG. 2, the detection sensor units 451, 452, and 453 are arranged so that the detection positions 711, 712, and 713 are arranged in directions parallel to the main scanning direction at different positions of the main scanning direction.

The detection sensor unit 451 (first detection sensor units) are disposed so that portions near the end of the primary transfer belt 61 in the main scanning direction are detection position 711. The detection sensor unit 452 (third detection sensor unit) is disposed so that a portion near the center of the primary transfer belt 61 in the main scanning direction is the detection position 712. The detection sensor unit 453 (second detection sensor unit) is disposed to be separated from the detection sensor unit 451 in the main scanning direction and is disposed so that the other end of the primary transfer belt 61 in the main scanning direction is the detection position 713.

The configuration of the exposure unit 43 is specifically described.

The present embodiment in which the exposure unit 43 corresponds to a laser scanning unit (LSU) and is a configuration in which an optical member for scanning is disposed on both sides of the polygon mirror is described. In the example of FIG. 2, the plurality of process units 421, 422, 423, and 424 are arranged in the sequence of black, cyan, magenta, and yellow in an order of being closer to the transfer nip.

As illustrated in FIG. 2, the exposure unit 43 includes a plurality of laser beam sources 911, 912, 913, and 914, a polygon mirror 92, a plurality of optical members, and a plurality of photodetectors 931 and 934.

The laser beam sources 911, 912, 913, and 914 are light sources that output laser beams. The laser beam sources 911, 912, 913, and 914 are, for example, laser diodes. The laser beam sources 911, 912, 913, and 914 are provided for the plurality of process units 421, 422, 423, and 424, respectively. That is, the laser beam sources 911, 912, 913, and 914 are provided to be correspond to black, cyan, magenta, and yellow, respectively.

The polygon mirror 92 is a rotating polygon mirror that includes a plurality of reflecting surfaces that reflect the laser beams output from the laser beam sources 91 and rotates at a constant speed. The reflecting surfaces are provided so that angles with respect to the incident direction of the laser beams in response to the rotation of the polygon mirror 92 change. The polygon mirror 92 rotates at a constant speed by a driving mechanism and reflects laser beam output from each of the laser beam sources 91 by the reflecting surfaces so that the traveling direction of the laser beam changes with time. Accordingly, the polygon mirror 92 deflects the laser beam output from each of the laser beam sources 91 in the main scanning direction on the photosensitive drum 51 of each of the process units 42.

The optical member is a light guide member that causes the laser beam reflected to the reflecting surface of the polygon mirror 92 to be incident to the photosensitive drums 51. The optical member is, for example, a reflecting mirror, a deflection lens, and the like provided for each of the process units 42. That is, the optical member is provided for each color of black, cyan, magenta, and yellow.

The optical member corresponding to black causes the laser beam that is output from the laser beam source 911 corresponding to black and reflected by the polygon mirror 92 to be incident to the photosensitive drum 511 of the process unit 421 corresponding to black. The optical member corresponding to cyan causes the laser beam that is output from the laser beam source 912 corresponding to cyan and reflected by the polygon mirror 92 to be incident to the photosensitive drum 512 of the process unit 422 corresponding to cyan. The optical member corresponding to magenta causes the laser beam that is output from the laser beam source 913 corresponding to magenta and reflected by the polygon mirror 92 to be incident to the photosensitive drum 513 of the process unit 423 corresponding to magenta. The optical member corresponding to yellow causes the laser beam that is output from the laser beam source 914 corresponding to yellow and reflected by the polygon mirror 92 to be incident to the photosensitive drum 514 of the process unit 424 corresponding to yellow.

The photodetectors 931 and 934 are beam detectors that detect the laser beams that are output from the corresponding laser beam sources 911 and 914 and reflected by the polygon mirror 92. The photodetectors 931 and 934 are also referred to as BD sensors. The photodetectors 931 and 934 include, for example, photodiodes, phototransistors, or other elements that generate electrical signals in response to light. If the laser beams are detected, the photodetectors 931 and 934 output beam detect signals (BD signals).

The photodetectors 931 and 934 are disposed on the light paths of the corresponding laser beams reflected by the polygon mirror 92. That is, the photodetector 931 is disposed at the position to which the laser beam that is reflected by the polygon mirror 92 and deflected in the main scanning direction on the photosensitive drum 511 of the process unit 421 is incident. The photodetector 934 is disposed at a position to which the laser beam that is reflected by the polygon mirror 92 and deflected in the main scanning direction on the photosensitive drum 514 of the process unit 424 is incident.

The plurality of laser beam sources 911, 912, 913, and 914, the plurality of optical members, and the plurality of photodetectors 931 and 934 are classified into a first system 94, a second system 95, a third system 96, and a fourth system 97. The laser beam source 911, the optical member, and the photodetector 931 which correspond to black are classified into the first system 94. The laser beam source 912, the optical member, and the photodetector 931 that correspond to cyan are classified into the second system 95. The laser beam source 913, the optical member, and the photodetector 934 that correspond to magenta are classified into the third system 96. The laser beam source 914, the optical member, and the photodetector 934 that correspond to yellow are classified into the fourth system 97. At least one of the photodetectors 931 and 934 is provided per two systems. That is, one photodetector 931 is provided for the first system 94 and the second system 95. One photodetector 934 is provided for the third system 96 and the fourth system 97. Photodetectors corresponding to the second system 95 (the laser beam source 912) and the third system 96 (the laser beam source 913) may be provided, respectively.

When the first system is the first system 94, the second system may be any system of the second system 95, the third system 96, or the fourth system 97. The first system is the second system 95, the second system is any system of the first system 94, the third system 96, or the fourth system 97. The same is applied when the first system is the third system 96 or the fourth system 97.

The photodetector 931 for the first system 94 and the second system 95 is output from the laser beam source 911 corresponding to black and is provided at a position to which the laser beams deflected by the polygon mirror 92 is incident.

The photodetector 934 for the third system 96 and the fourth system 97 is output from the laser beam source 914 corresponding to yellow and is provided at a position to which the laser beam deflected by the polygon mirror 92 is incident.

An operation of the exposure unit 43 is described.

In the configuration, the processor 21 of the system controller 13 inputs the image data for printing to the exposure unit 43. The image data is data indicating the concentration of each color.

The exposure unit 43 converts the image data into driving signals of the laser beam sources 911, 912, 913, and 914 of each color of black, cyan, magenta, and yellow and input the driving signals to each of the laser beam sources 911, 912, 913, and 914. Accordingly, the laser beams are output from the laser beam sources 911, 912, 913, and 914.

The laser beams output from the laser beam sources 911, 912, 913, and 914 are reflected by the reflecting surfaces of the rotating polygon mirror 92, respectively. Therefore, the traveling direction of the laser beam incident to the polygon mirror 92 changes according to the rotation of the polygon mirror 92. The laser beams reflected by the polygon mirror 92 are deflected in the main scanning directions of the photosensitive drums 511, 512, 513, and 514 corresponding thereto via the optical member. That is, the laser beams output from the laser beam sources 911, 912, 913, and 914 are irradiated in the main scanning direction over the entire range of the corresponding photosensitive drums 511, 512, 513, and 514.

The photodetectors 931 and 934 detect the laser beams reflected by the polygon mirror 92 and output BD signals to the system controller 13.

The processor 21 of the system controller 13 generates a synchronization signal. The synchronization signal is a main scanning counter that becomes a reference of the timing of the operation, for example, per two systems of the first system 94, the second system 95, the third system 96, and the fourth system 97. The processor 21 determines an image data area on the main scanning counter based on the BD signal. For example, the processor 21 determines a predetermined position on the main scanning counter, that is, a predetermined count area of the main scanning counter as the image data area.

The image data area is an area for forming an electrostatic latent image based on the image data on the photosensitive drums 511, 512, 513, and 514. The image data area indicates an exposure start position and an exposure end position. The exposure start position indicates a timing when the irradiation of the laser beam starts, based on the image data. The exposure start position indicates a count value of the main scanning counter when the irradiation with the laser beam based on the image data starts. The exposure end position indicates a timing when the irradiation with the laser beam based on the image data ends. The exposure end position indicates a count value of the main scanning counter when the irradiation with the laser beam based on the image data ends. The distance between the exposure start position and the exposure end position is determined by a paper size for a recording medium for printing.

The processor 21 resets the main scanning counter based on the BD signal. That is, the processor 21 resets the main scanning counter at the timing when the BD signal is input from the photodetectors 931 and 934. Accordingly, the timing when the main scanning counter is "0" is determined so that the exposure start position and the exposure end position in the next line are determined.

For example, the processor 21 determines the exposure start positions and the exposure end positions of the laser beam sources 911 and 912 of the first system 94 and the second system 95 based on the timing when the BD signals are input from the photodetector 931 of the first system 94 and the second system 95. For example, the processor 21 determines the exposure start position and the exposure end position of the laser beam sources 913 and 914 of the third system 96 and the fourth system 97 based on the timing when the BD signals are input from the photodetector 934 of the third system 96 and the fourth system 97.

The processor 21 controls the exposure unit 43 so that the laser beam is output from the laser beam sources 911, 912, 913, and 914 in response to the image data from the exposure start position to the exposure end position. For example, the processor 21 inputs the image data for one line from the exposure start position to the exposure end position and executes the exposure, to the exposure unit 43. Accordingly, the laser beam in response to the image data from the exposure start position to the exposure end position is output from each of the laser beam sources 911, 912, 913, and 914. As a result, the laser beam reflected by the polygon mirror 92 is deflected in the main scanning directions of each of the photoconductor drums 51, and the electrostatic latent image is formed on each of the photoconductor drums 511, 512, 513, and 514.

The processor 21 controls the exposure unit 43 so that the laser beam from the exposure end position to the next exposure start position is continuously output from the laser beam sources 911, 912, 913, and 914. Accordingly, the laser beam is incident to the photodetectors 931 and 934 between the exposure end position and the exposure start position, and the BD signal from the photodetectors 931 and 934 is input to the system controller 13.

The processor 21 resets the main scanning counter whenever the BD signals are input from the photodetectors 931 and 934 of each system. Accordingly, the processor 21 determines the exposure start position and the exposure end position for one line by one, and inputs the image data to the exposure unit 43 for one line by one.

The color shift correction process (registration control process) is described.

In order to maintain the image quality, the processor 21 forms a test pattern (registration pattern) with the toners and causes the plurality of detection sensor units 451, 452, and 453 to detect the formed test pattern. The processor 21 performs the color shift correction process in the image forming process based on the detection results of the plurality of detection sensor units 451, 452, and 453. The color shift correction process is a process for correcting the deviation of the printing positions of each color. The color shift correction process is so-called color registration.

The processor 21 detects the occurrence of the error based on the detection result of the corresponding test patterns by the plurality of detection sensor units 451, 452, and 453, respectively, and discriminates the component to be the occurrence cause of the error. The component to be the occurrence cause of the error includes, for example, the plurality of process units 42, the exposure unit 43, the transfer belt unit 44, the plurality of detection sensor units 451, 452, and 453, and the other units (for example, a power supply unit such as the charging chargers 52). When there are a plurality of components that is possibly to be the occurrence cause of the error, the processor 21 can notify of the components in an order of high possibilities of the occurrence causes of the errors.

As illustrated in FIG. 2, the processor 21 controls the image forming unit 19 so that toner images of test patterns 111 to 114, 121 to 124, and 131 to 134 on the primary transfer belt 61 are formed by each of the process units 42. That is, the processor 21 controls the image forming unit 19 so that the test patterns 111 to 114, 121 to 124, and 131 to 134 of each of the plurality of colors are formed.

The plurality of test patterns 111 to 114 are first test patterns corresponding to the detection sensor unit 451. The test patterns 111 to 114 are formed at the position of passing through the detection position 711 by the detection sensor unit 451. The plurality of test patterns 121 to 124 are third test patterns corresponding to the detection sensor unit 452. The test patterns 121 to 124 are formed at a position of passing through the detection position 712 by the detection sensor unit 452. The plurality of test patterns 131 to 134 are second test patterns corresponding to the detection sensor unit 453. The test patterns 131 to 134 are formed at a position of passing through the detection position 713 by the detection sensor unit 453.

The test pattern 111 is a black pattern, the test pattern 112 is a cyan pattern, the test pattern 113 is a magenta pattern, and the test pattern 114 is a yellow pattern. The test patterns 121 to 124, and 131 to 134 are formed in sequences of the colors (black, cyan, magenta, yellow) that are the same as the test patterns 111 to 114, respectively.

Tips of the test patterns 111 to 114, 121 to 124, and 131 to 134 of the plurality of colors in the sub-scanning direction are formed at the same timings by the process units 42 of the plurality of colors. That is, the tips of the test patterns 111 to 114, 121 to 124, and 131 to 134 in the sub-scanning direction are formed based on the electrostatic latent image for one line, that is formed on the photosensitive drums 511, 512, 513, and 514 by causing the laser beams output from the laser beam sources 911, 912, 913, and 914 at the same timing to be incident to the photosensitive drums 511, 512, 513, and 514. For example, the test patterns 111, 121, and 131 formed by the black toner image are formed at the same timing by the process unit 421 corresponding to the black toner.

The test patterns 111 to 114, 121 to 124, and 131 to 134 have linear side orthogonal to the sub-scanning direction and parallel to the main scanning direction. The side that is orthogonal to the sub-scanning direction of a test pattern 101 and parallel to the main scanning direction is referred to as a first side.

As illustrated in FIG. 2, the test patterns 111 to 114, 121 to 124, and 131 to 134 include portions where toner image forming positions change to the sub-scanning direction in response to positions of the main scanning direction. That is, the test patterns 111 to 114, 121 to 124, and 131 to 134 have the linear sides formed in the diagonal direction to the main scanning direction and the sub-scanning direction. The side of the test pattern 101 in a diagonal direction to the main scanning direction and the sub-scanning direction is referred to as a second side.

There is a gap in which a toner image is not formed, between the first side and the second side in the sub-scanning direction.

A shift of each color to the printing position in the sub-scanning direction and a shift of each color to the printing position in the main scanning direction are reflected to the test patterns 111 to 114, 121 to 124, and 131 to 134 formed as above.

If the first sides of the test patterns 111 to 114, 121 to 124, and 131 to 134 with such shapes reach the detection positions 711, 712, and 713 of the detection sensor units 451, 452, and 453, detection results obtained by detecting the first sides of the test patterns 111 to 114, 121 to 124, and 131 to 134 by the detection sensor units 451, 452, and 453 are in on states.

Subsequently, if gaps between the first sides and the second sides of the test patterns 111 to 114, 121 to 124, and 131 to 134 reach the detection positions 711, 712, and 713 of the detection sensor units 451, 452, and 453, the detection results of the detection sensor units 451, 452, and 453 are in off states.

Subsequently, second sides of the test patterns 111 to 114, 121 to 124, and 131 to 134 reach the detection positions 711, 712, and 713 of the detection sensor units 451, 452, and 453, the detection results obtained by detecting the second sides of the test patterns 111 to 114, 121 to 124, and 131 to 134 by the detection sensor units 451, 452, and 453 are in the on states, again.

Here, time intervals between the timings when the first sides of the test patterns 111 to 114, 121 to 124, and 131 to 134 are detected, that is, the timings when the detection results become in on states for the first time, and the timing when the second sides of the test patterns 111 to 114, 121 to 124, and 131 to 134 are detected, that is, the timing when the detection results are in the on state, for the next time change in response to the positions of the test patterns 111 to 114, 121 to 124, and 131 to 134 in the main scanning direction.

The processor 21 detects first test pattern (the test patterns 111 to 114), third test pattern (the test patterns 121 to 124), second test pattern (the test patterns 131 to 134) with the plurality of detection sensor units 451, 452, and 453, respectively, and acquire the detection results.

The processor 21 has a function as a timer for counting the time interval. The processor 21 starts counting from the reference timing of the pattern detection start and acquires the detection result with respect to each of the test patterns 111 to 114, 121 to 124, and 131 to 134, based on the count values of the time intervals of the timings when the first sides of the test patterns 111 to 114, 121 to 124, and 131 to 134 are detected by the detection sensor units 451, 452, and 453 and the threshold values with respect to the detection timings of the test patterns 111 to 114, 121 to 124, and 131 to 134.

With respect to detection results of the test patterns 111 to 114, 121 to 124, and 131 to 134, the processor 21 determines the difference from the determination condition when an error does not occur in the component and determines that there is a difference, the processor 21 discriminates a component to be the occurrence cause of the difference based on a combination of the detection results of the test patterns 111 to 114, 121 to 124, and 131 to 134.

The processor 21 determines, for example, the difference from the determination condition with respect to the detection result provided below.

(A) when the Number of Detections of the Test Pattern is the Determination Condition The processor 21 determines the difference from the number to be the determination condition with respect to the number of detections of the test patterns included in each of the first test pattern, the third test pattern, and the second test pattern. The determination condition when the error does not occur is the number of detections of "4".

(B) When the Portion where the Detection Timings of the Test Patterns are Different from the Threshold Value is the Determination Condition With respect to the detection timing of each test pattern, the processor 21 determines whether the test patterns are detected in the area of the threshold value that is set in advance. The processor 21 determines what is the portion where the detection timing of the test pattern is not detected in the area of the threshold value. For example, the processor 21 determines whether the test pattern is which one of the first test pattern, the third test pattern, and the second test pattern and which one of the test patterns 111 to 114, 121 to 124, and 131 to 134.

(C) When the Direction of the Shift at the Detection Timing from the Threshold Value with Respect to Each Test Pattern is the Determination Condition The processor 21 determines the direction of the shift at the detection timing of each test pattern, from the threshold value at the detection timing to be the determination condition. The processor 21 determines whether the detection timing of the test pattern is shifted to an early timing or to a late timing compared with the threshold value for each test pattern.

(D) When a Combination in a Case where Detection Timings of the Plurality of Test Patterns are Different from the Threshold Value is the Determination Condition When the processor 21 determines that the detection timings of the plurality of test patterns are different from the threshold value, the condition (combination) common to the results determined that there are a plurality of differences is determined.

The processor 21 discriminates the component to be the occurrence cause of the difference, for example, based on the determination results indicated by (1) to (4).

An example of an operation of the image forming device 1 including the color shift correction process is described.

Figure 3:
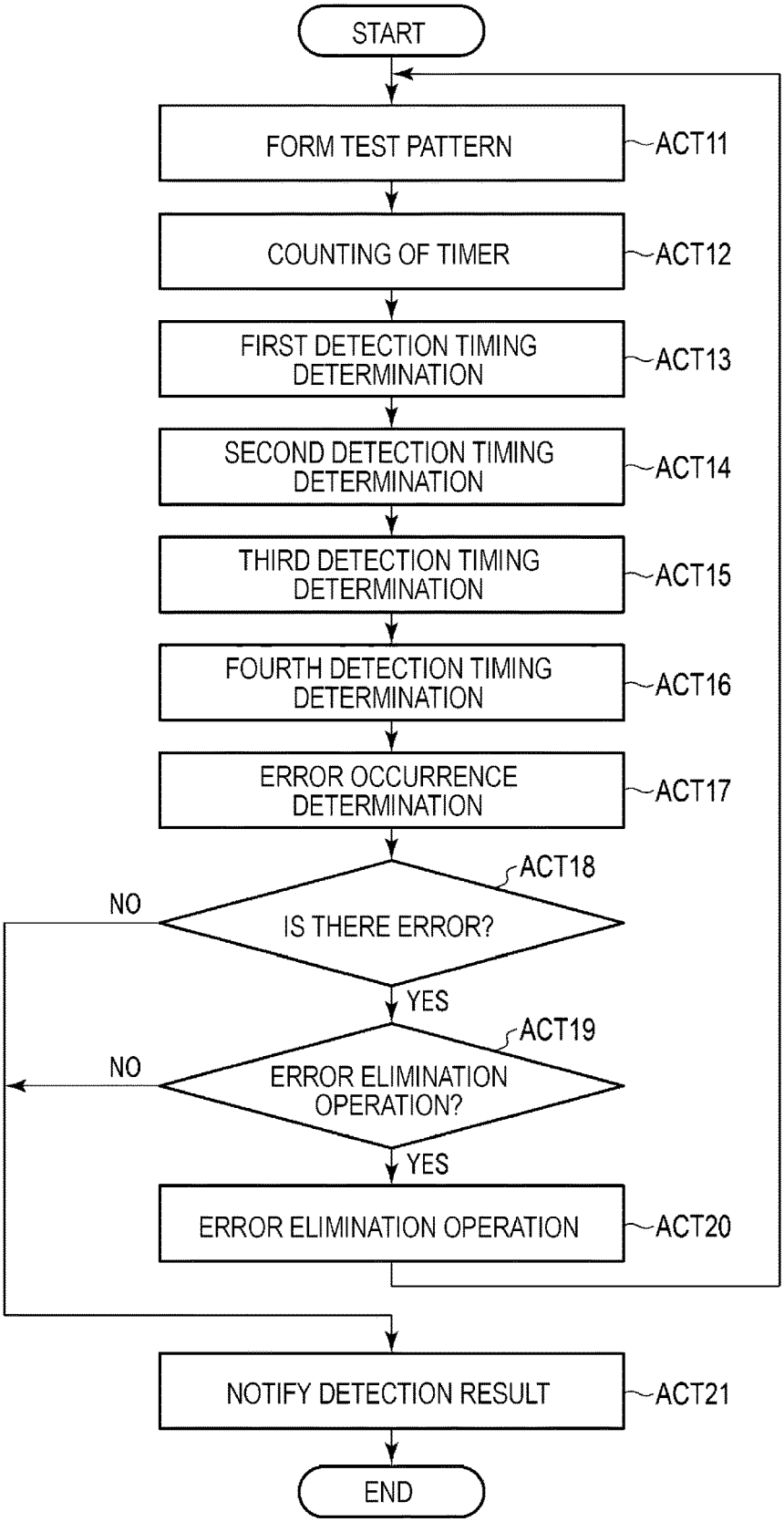
FIG. 3 is a flowchart illustrating an example of a color shift correction process of the image forming device.

FIG. 3 is a flowchart illustrating the example of the color shift correction process (registration control process) of the image forming device 1.

Hereinafter, for easier understanding, the process using the detection results of the first test pattern (the test patterns 111 to 114) and the second test pattern (the test patterns 131 to 134) by two detection sensor units 451 and 453 is described.

If the execution of the registration control process is started, the processor 21 controls the image forming unit 19 so that the toner images of the first test pattern (the test patterns 111 to 114) and the second test pattern (the test patterns 131 to 134) are formed on the primary transfer belt 61 (ACT 11). That is, the processor 21 controls the rotation speed of the polygon mirror 92, the rotation speed of the photosensitive drums 51, the conveyance speed of the recording medium by the conveyance mechanism 18, and the movement speed of the primary transfer belt 61 at normal speeds and controls the exposure unit 43 so that the laser beams are output at first laser power.

Figure 4:
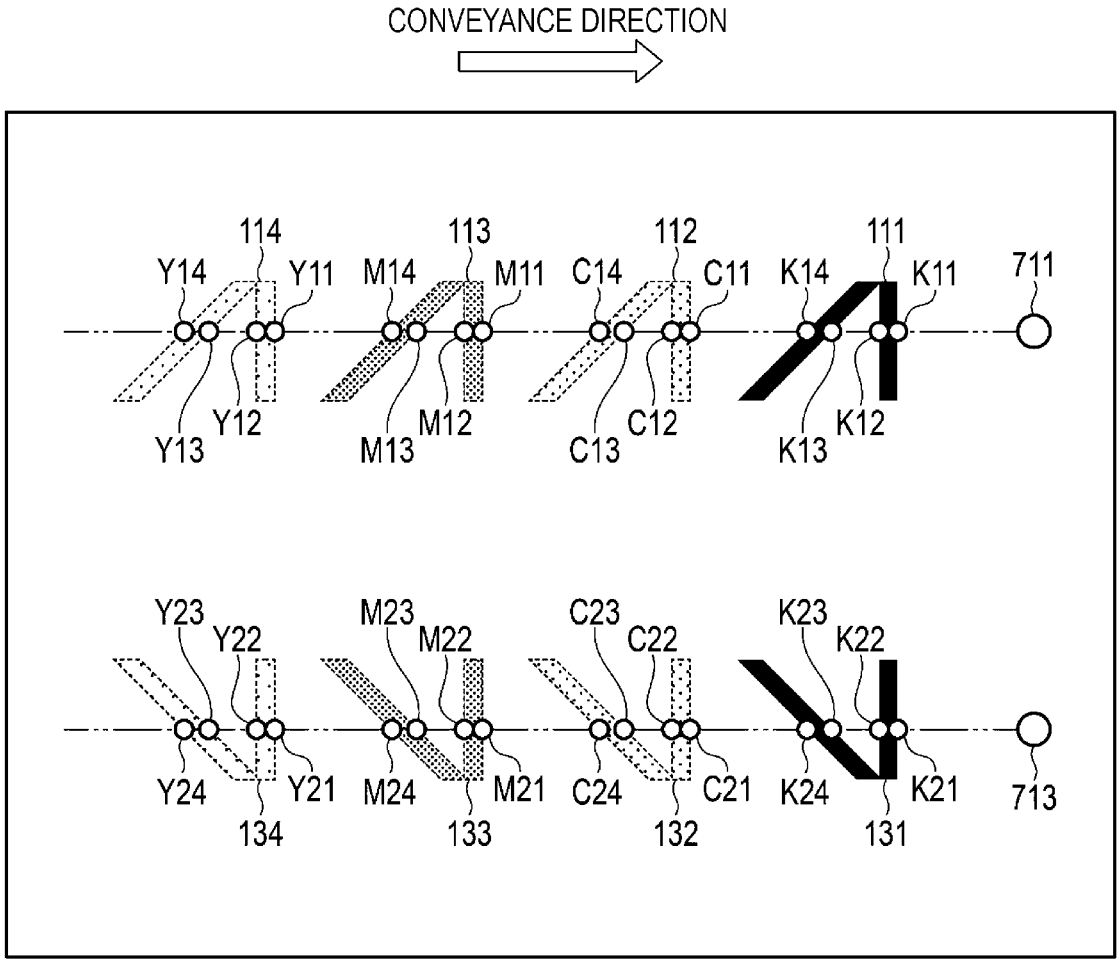
FIG. 4 is a diagram illustrating an example of a test pattern according to the embodiment.

FIG. 4 is a diagram illustrating an example of the test patterns.

In ACT 11, the toner image of the first test patterns (the test patterns 111 to 114) and the second test patterns illustrated in FIG. 4 are formed on the primary transfer belt 61. FIG. 4 is an explanatory diagram illustrating positions of the first test patterns and the second test patterns and the detection positions 711 and 713 of the detection sensor units 451 and 453.

In the example of FIG. 4, the test patterns 111 to 114 are arranged on the rear side and the test patterns 131 to 134 are arranged on the front side, in the sequence of black, cyan, magenta, and yellow, in the sub-scanning direction, that is, the conveyance direction of the primary transfer belt 61. The test patterns 111 to 114 are formed to pass through the detection position 711 of the detection sensor unit 451, and the test patterns 131 to 134 are formed to pass through the detection position 713 of the detection sensor unit 453.

Subsequently, the processor 21 starts counting of the timer from the reference timing of the pattern detection start (ACT 12), and detects the first test pattern and the second test pattern by the detection sensor units 451 and 453.

The processor 21 determines the first detection timing based on the detection timing with respect to the test pattern 111 (first test pattern) and the test pattern 131 (second test pattern) of the black toner image and the threshold value with respect to the detection timing corresponding to the black toner image (ACT 13).

Figure 5:
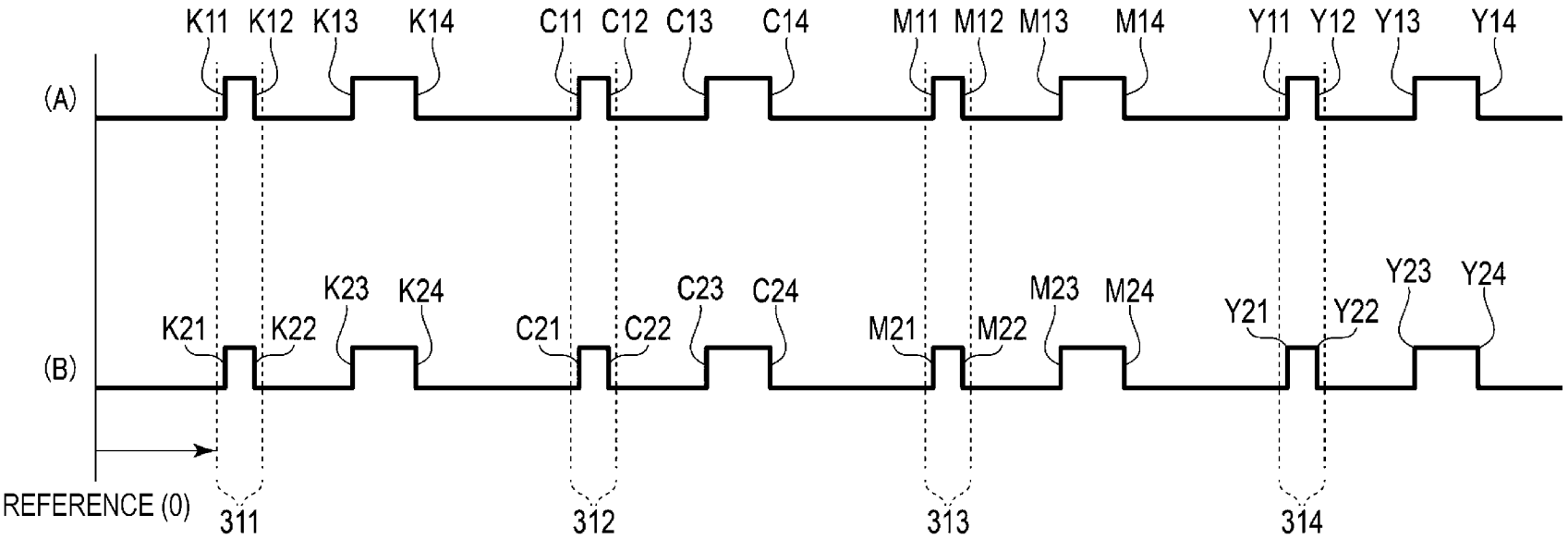
FIG. 5 is a diagram illustrating a test pattern, a detection timing, and a threshold value according to the embodiment.

FIG. 5 is a diagram illustrating the detection timings and threshold values of the test patterns. (A) of FIG. 5 illustrates the detection timing of the test pattern by the detection sensor unit 451, and (B) of FIG. 5 illustrates the detection timing of the test pattern by the detection sensor unit 453.

As illustrated in FIG. 5, a threshold value 311 is set with respect to the test patterns 111 and 131 of the black toner image. FIG. 5 illustrates an example of setting the threshold value only for the first side of the test pattern. That is, the processor 21 sets a first threshold value with respect to timings K11 and K21 when detection for the first sides of the test patterns 111 and 131 is in an on state and a second threshold value with respect to timings K12 and K22 when detection for the first sides of the test patterns 111 and 131 is in an off state. The processor 21 determines that an error does not occur when the timing when the on and off states of the test patterns 111 and 131 are detected is between the first threshold value and the second threshold value of the threshold value 311.

A threshold value for the detection timing of the second side of the test pattern is set, and timing determination with respect to the detection timing of the second sides may be executed. Threshold values are set for both of the first side and the second side of the test pattern, respectively, to execute the timing determination. Here, the determination result of the test pattern may be determined based on the combination of the determination results of the detection timings with respect to the first side and the second side.

As such, the processor 21 determines the second detection timing based on detection timings C11, C12, C21, and C22 for the test patterns 112 and 132 of the cyan toner image and a threshold value 312 corresponding to the cyan toner image (ACT 14).

The processor 21 determines a third detection timing based on detection timings M11, M12, M21, and M22 with respect to the test patterns 113 and 133 of the magenta toner image and a threshold value 313 corresponding to the magenta toner image (ACT 15).

The processor 21 determines a fourth detection timing based on detection timings Y11, Y12, Y21, and Y22 with respect to the test patterns 114 and 134 of the yellow toner image and a threshold value 314 corresponding to the yellow toner image (ACT 16).

The processor 21 determines whether an error occurs in a component based on the determination results in ACTS 13 to 16 (ACT 17). That is, the processor 21 determines whether the detection results of the first test pattern and the second test pattern are different from the determination condition.

When it is determined that there is a difference, the processor 21 discriminates a component to be the occurrence cause of the difference, based on a combination of the detection result of the first test pattern and the detection result of the second test pattern. The processor 21 determines a component with a high possibility of the occurrence cause of the difference based on the combination of the detection result of the first test pattern and the detection result of the second test pattern.

Here, it is determined that there is no difference (No in ACT 18), the processor 21 notifies that an error does not occur in the component, as the detection result, from an output device (ACT 21). For example, the processor 21 causes the display unit 14 to display information indicating that an error does not occur or controls each component relating to printing so that the information indicating that an error does not occur is printed on a paper medium. If it is determined that an error occurs, the detection result may not be notified.

Meanwhile, when it is determined that an error occurs (Yes in ACT 18), if an error elimination operation is possible for the component determined to have a high possibility of the occurrence cause of the error (Yes in ACT 19), the processor 21 executes an error elimination operation (ACT 20) and executes processes from ACT 11, again. As a result, it is likely that the component is in a state in which an error does not occur and is determined that a difference from the detection results with respect to the first test pattern and the second test pattern is eliminated in ACT 17.

Accordingly, omission of the investigation and the repair for specifying a portion to be the cause of the error occurrence with respect to the image forming device by the worker can be expected.

When there are a plurality of components determined to have possibilities of the occurrence causes of the error, the processor 21 may sequentially execute an error elimination operation for one portion by one with respect to the plurality of components and execute processes from ACT 11, again. Here, in the sequence of the components with high possibilities of the occurrence causes, it is desired to execute the error elimination operation. The processor 21 ends a process when it is determined that the errors are eliminated by the error elimination operations with respect to any components.

In the descriptions described above, if an error elimination operation is possible (Yes in ACT 19), the error elimination operation is executed (ACT 20). However, even if the error elimination operation is possible, the processor 21 may not execute the error elimination operation. For example, before the execution of the registration control process, a setting of not executing the error elimination operation can be made by an operation of a worker to the operation interface 15. When the setting of not executing the error elimination operation is made, the processor 21 does not execute the error elimination operation even if the error elimination operation is possible.

If the error elimination operation is not executed (No in ACT 19), the processor 21 notifies that an error occurs as the detection result from the output device (ACT 21). For example, the processor 21 notifies that an error occurs and also the information relating to the component with a high possibility of the occurrence cause of the error. If there are a plurality of components with high possibilities of the occurrence causes of the errors, the processor 21 notifies that the sequence of the components of high possibilities of the occurrence causes.

Accordingly, an investigation with respect to the image forming device 1 by the worker for specifying a portion to be the cause of the error occurrence is omitted, and the component with a high possibility of the occurrence cause can be immediately repaired. Accordingly, even if the worker does not have a sufficient experience, reduction of time required for the repair for elimination of an error occurring in the image forming device 1 can be expected.

Specific examples (1) to (4) of the component determined to be the occurrence cause which occurs a difference from the threshold value at the detection timing of the test pattern are described.

Figure 6A:
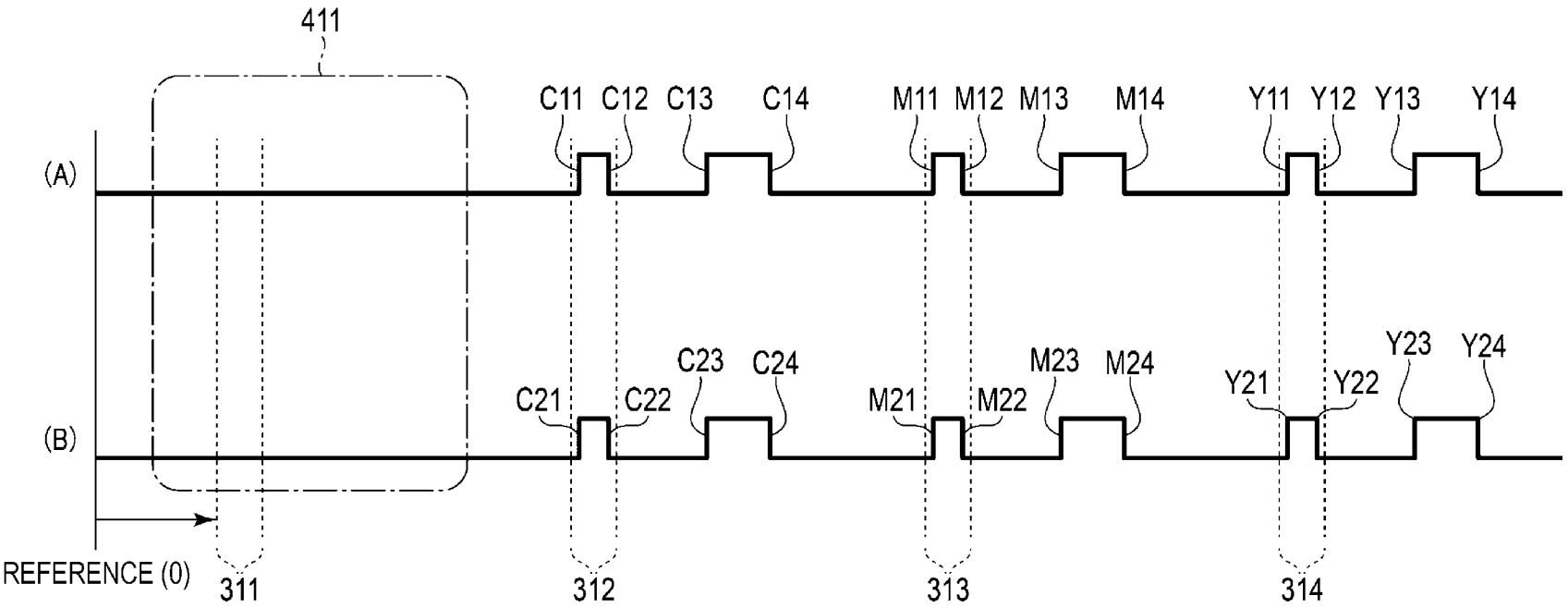
FIG. 6A is a diagram illustrating a detection timing of a test pattern by a detection sensor unit according to the embodiment.

(1) Example of Determining an Occurrence Cause Based on the Number of Detections of the Test Pattern FIG. 6A is a diagram illustrating detection timings of the test patterns by the detection sensor unit. (A) of FIG. 6A indicates a detection timing of the test pattern by the detection sensor unit 451, and (B) of FIG. 6A indicates a detection timing of the test pattern by the detection sensor unit 453. FIG. 6B is a diagram illustrating an example of the detection result notified based on the test pattern illustrated in FIG. 6A.

When an error does not occur, test patterns corresponding to respective four colors are detected with respect to the first test pattern and the second test pattern (the number of detections of the first side of the test pattern is 4). In an example of a difference occurrence portion 411 illustrated in FIG. 6A, the test patterns 111 and 131 of the black toner image are not detected (the number of detections of the first side of the test pattern is 3). The second sides of the test patterns 111 and 131 are not detected. Accordingly, the processor 21 determines that the component for forming the black toner image is the component with a high possibility of the occurrence cause of the error.

As a result, as illustrated in FIG. 6B, the processor 21 determines that the occurrence cause of the error is highly possible in the sequence of the exposure unit 43 (first place) and the process units 42 (second place). With respect to the exposure unit 43, it can be determined that the first system 94 for forming a black (K color) toner image (the laser beam source 911, the optical member, and the photodetector 931) is highly possibly the occurrence cause of the error. In the example of the difference occurrence portion 411 illustrated in FIG. 6A, it is not possible to specify which one of the exposure unit 43 and the process units 42 is the component to be the occurrence cause of the error. Therefore, the sequence of high possibility of the occurrence cause of the error may be the sequence of the process units 42 (first place) and the exposure unit 43 (second place). As the other components, the processor 21 determines that the charging charger 52 that applies the voltage to the photosensitive drum 51 for forming the black toner image is highly possibly the occurrence cause of the error (third place). The processor 21 notifies the information of the detection result illustrated in FIG. 6B from the output device.

Figure 7A:
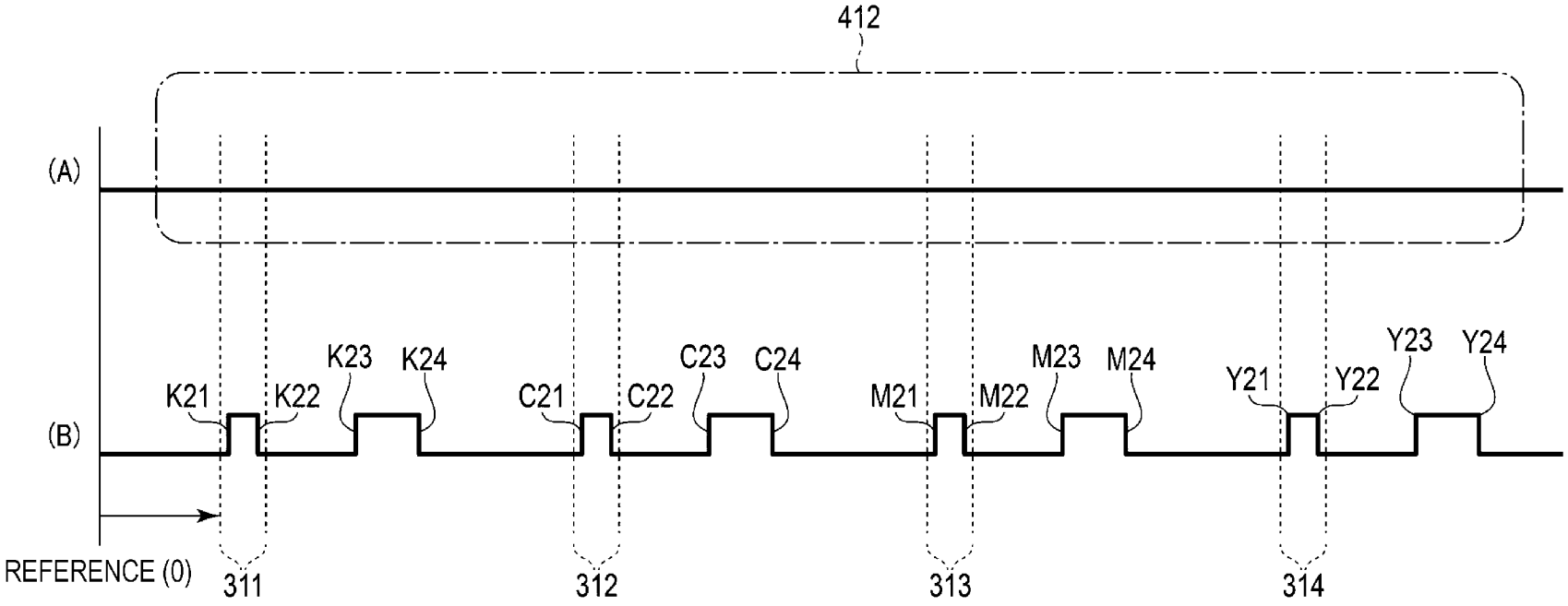
FIG. 7A is a diagram illustrating the detection timing of the test pattern by the detection sensor unit.

(2) Example in which the Occurrence Cause is Determined Based on the Portion where the Detection Timing of the Test Pattern is Different from the Threshold Value FIG. 7A is a diagram illustrating detection timings of the test patterns by the detection sensor unit. (A) of FIG. 7A illustrates detection timings of the test patterns by the detection sensor unit 451, and (B) of FIG. 7 illustrates detection timings of the test patterns by the detection sensor unit 453. FIG. 7B is a diagram illustrating an example of detection results notified based on the test patterns illustrated in FIG. 7A.

When an error does not occur, test patterns corresponding to respective four colors are detected with respect to the first test pattern and the second test pattern (the number of detections of the first side of the test pattern is 4). In the example of a difference occurrence portion 412 illustrated in FIG. 7A, none of the first test patterns on the rear side (the test patterns 111 to 114) are detected (the number of detections of the first side of the test pattern is 0). Accordingly, the processor 21 determines that a component detecting the entire first test pattern on the rear side or a component for forming the entire toner image of the first test pattern on the rear side is highly possibly the occurrence cause of the error.

As a result, as illustrated in FIG. 7B, the processor 21 determines that the detection sensor unit 451 for detecting the first test pattern on the rear side is highly possibly the occurrence cause of the error (first place). Due to the influence of the inclination of the transfer belt unit 44 or the like, as a component that cannot normally form the first test pattern toner image on the rear side, it is determined that the transfer belt unit 44 is highly possibly the occurrence cause of the error (second place). As the other component, the processor 21 determines the power supply unit that supplies electric power to the detection sensor unit 451 as a component that is highly possibly the occurrence cause of the error (third place). The processor 21 causes the information of the detection result illustrated in FIG. 7B to be notified from the output device.

Figure 8A:
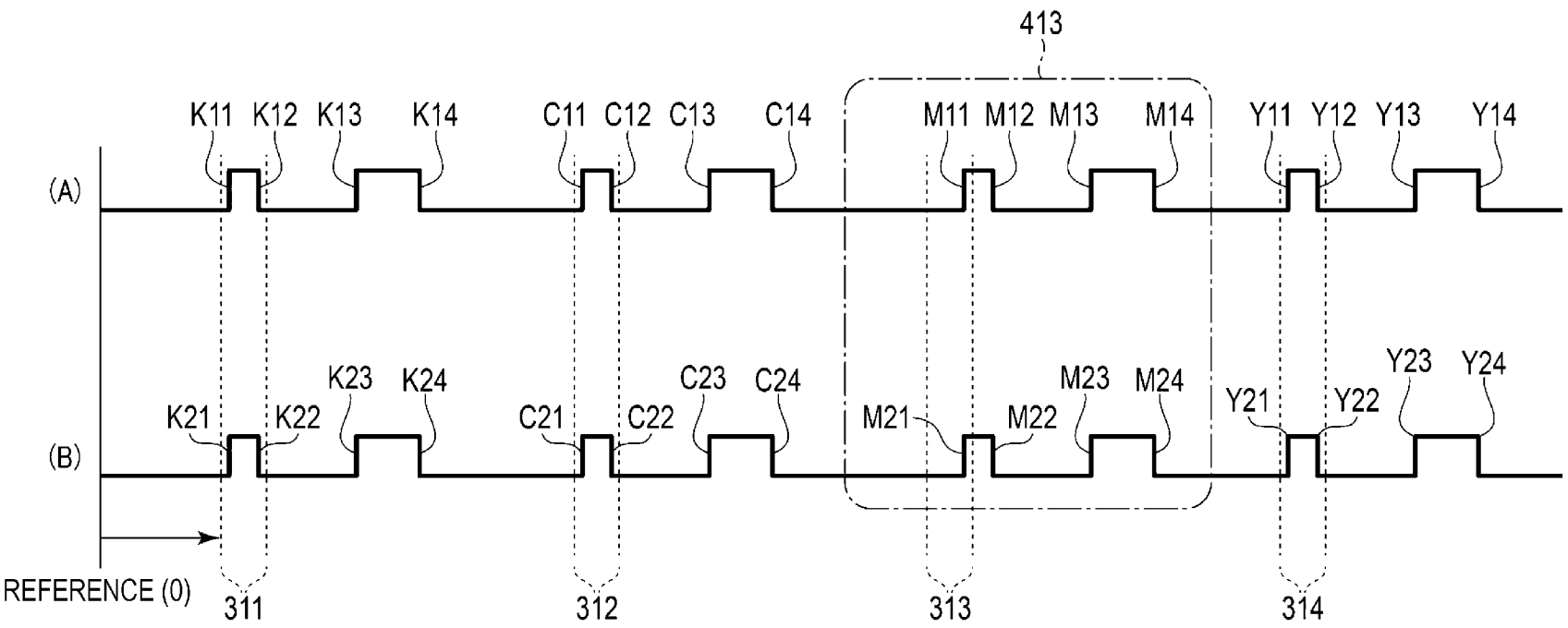
FIG. 8A is a diagram illustrating a detection timing of the test pattern according to the detection sensor unit.

(3) Example in which the Occurrence Cause is Determined Based on the Direction of the Shift with Respect to the Threshold Value of the Detection Timing of the Test Pattern FIG. 8A is a diagram illustrating detection timings of the test patterns by the detection sensor unit. (A) of FIG. 8A indicates the detection timings of the test patterns by the detection sensor unit 451, and (B) of FIG. 8 indicates the detection timings of the test patterns by the detection sensor unit 453. FIG. 8B is a diagram illustrating an example of detection results notified based on the test pattern illustrated in FIG. 8A.

When an error does not occur, with respect to the first test pattern and the second test pattern, the detection timings of the on state and the off state of the test patterns respectively corresponding to the four colors are detected in the respectively set areas of the threshold values 311 to 314. In the example of an error (difference) occurrence portion 413 illustrated in FIG. 8A, the test patterns 113 and 133 of the magenta toner image are detected at a timing earlier than the threshold value 313.

As a result, as illustrated in FIG. 8B, the processor 21 determines the occurrence cause of the error is highly possible in the sequence of the process units 42 (first place) for forming a magenta (M color) toner image and the exposure unit 43 (second place) (here, the sequence may be a sequence of the exposure unit 43 (first place) and the process units 42 (second place)). The exposure unit 43 can determine that the third system 96 (the laser beam source 913, the optical member, and the photodetector 934) for forming the magenta (M color) toner image is highly possibly the occurrence cause of the error. The processor 21 determines that the other component for forming the magenta toner image is highly possibly the occurrence cause of the error (third place). The processor 21 causes the information of the detection result illustrated in FIG. 8B to be notified from the output device.

Here, the processor 21 controls the plurality of components including the third system 96 of the exposure unit 43 and the process units 42 so that the timing of forming the magenta (M color) toner image is delayed in response to the shift amount of the threshold value 313, as the error elimination operation. Accordingly, an error occurring in the image forming device 1 can be eliminated without a work by the worker.

(1) to (3) described above are examples, and a component to be the cause for which the detection timing of the test pattern is not detected in the area of the threshold value can be discriminated by combining any.

Figure 9A:
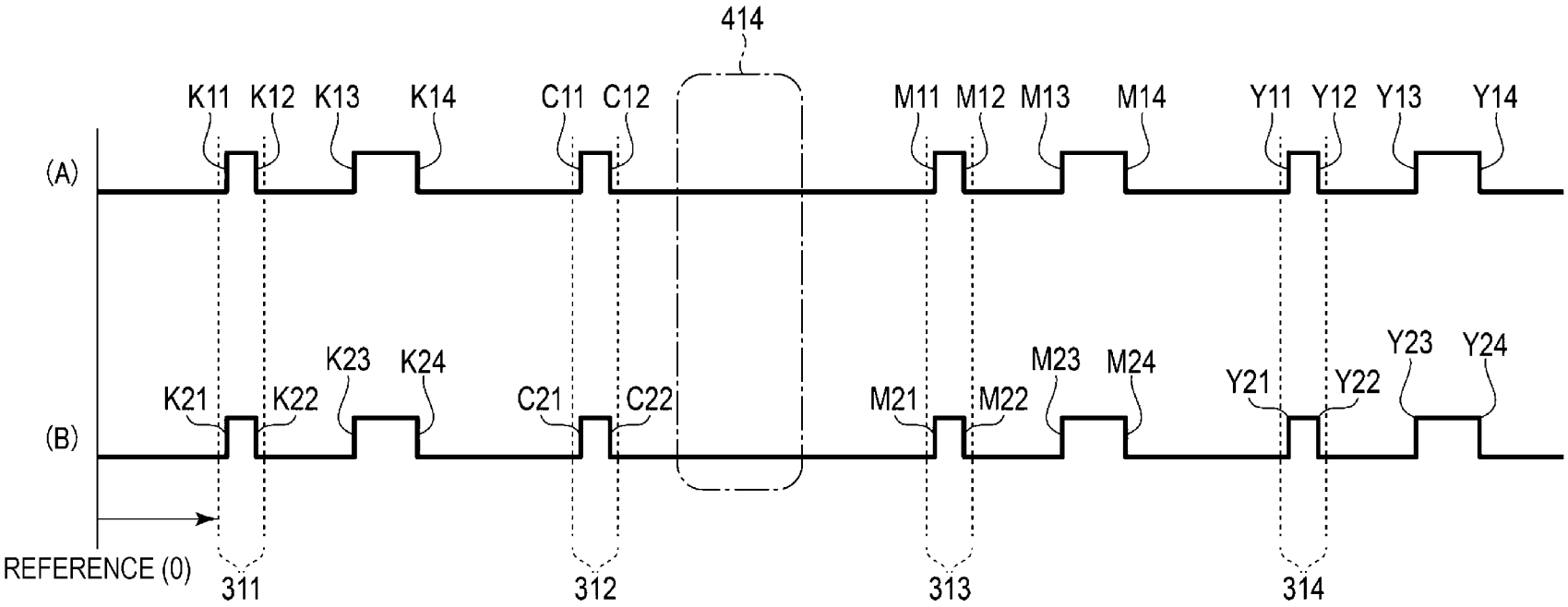
FIG. 9A is a diagram illustrating a detection timing of the test pattern by the detection sensor unit.
Figure 9B:
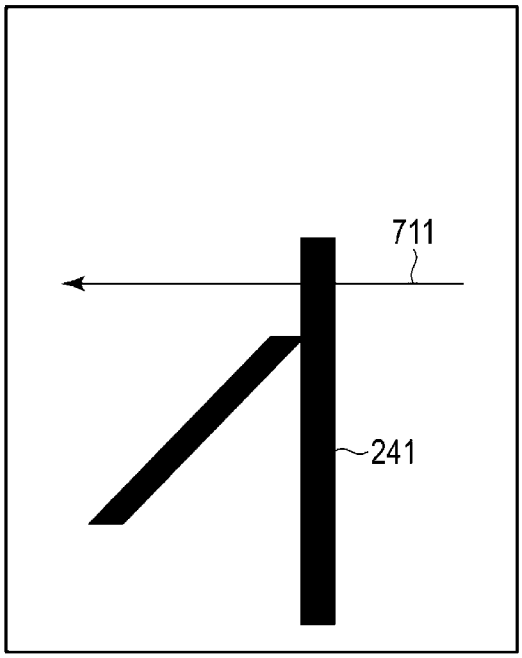
FIG. 9B is a diagram illustrating an example of the test pattern of another shape according to the embodiment.
Figure 9C:
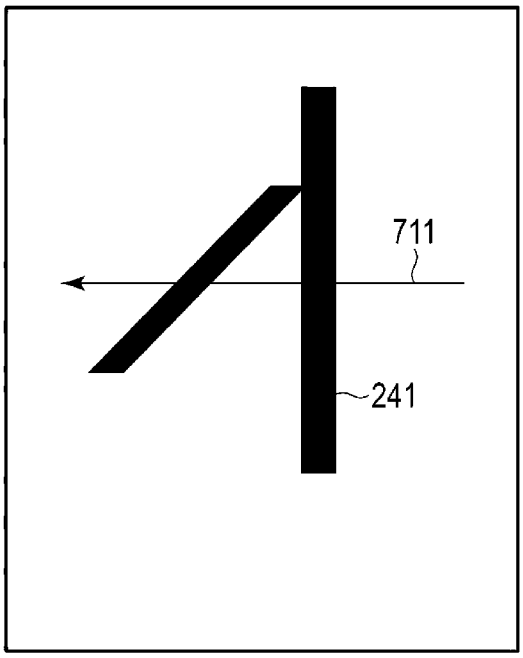
FIG. 9C is diagram illustrating an example of the test pattern of another shape according to the embodiment.

(4) Example in which an Error Cause Determined Based on the Shift of the Detection Timing by Using the Test Pattern of Another Shape FIG. 9A is a diagram illustrating detection timings of the test patterns by the detection sensor unit. (A) of FIG. 9A illustrates detection timings of the test patterns by the detection sensor unit 451, and (B) of FIG. 9 illustrates detection timings of the test patterns by the detection sensor unit 453. FIGS. 9B and 9C are diagrams illustrating an example of a test pattern 241 of another shape.

In the above description, the detection timing of the first side of the test pattern is determined based on the threshold value, but the occurrence of the error herein is determined based on detection results of detection timings of a first side and a second side of the test pattern.

The test pattern 241 illustrated in FIGS. 9B and 9C includes a linear first side that is formed in the main scanning direction and a linear second side that is in a diagonal direction to the main scanning direction and shorter than the first side in the main scanning direction.

In the example of a difference occurrence portion 414 illustrated in FIG. 9A, with respect to the test patterns 111 and 131 of the cyan toner image, the first side is detected, but the second side is not detected. That is, with respect to the cyan test pattern 241 formed on the rear side, the detection position 711 by the detection sensor unit 451 is in an error state of passing through only the first side.

Accordingly, the processor 21 can determine that a component for forming the cyan toner image is a component with a high possibility of the occurrence cause of the error, and is in an error state in which the toner image is formed in a state of being shifted in the main scanning direction.

Here, the processor 21 controls the plurality of components so that the cyan (C color) toner image is formed to be shifted in the main scanning direction as the error elimination operation. Accordingly, as illustrated in FIG. 9C, the toner image can be formed at a position where the detection position 711 by the detection sensor unit 451 passes through both of the first side and the second side. Accordingly, an error occurring in the image forming device 1 can be eliminated without a work by the worker.

As such, by causing the test pattern 241 to be in a shape for easier determination of an error state, an error elimination operation is accurately executed to eliminate an error.

The test pattern of another shape illustrated in FIGS. 9B and 9C is an example, and the other shape can be used.

The functions described in each of the above embodiments are not limited to being configured by using hardware and can also be realized by loading a program describing each function into a computer by using software. Each function may be configured by appropriately selecting either software or hardware.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image forming device, comprising:

a first photoconductor that rotates about a main scanning direction as an axis;

an exposure component that causes a first laser beam to be incident on the first photoconductor in the main scanning direction in response to an image and forms a first electrostatic latent image on the first photoconductor;

a first developing device that attaches toner to the first electrostatic latent image of the first photoconductor to form a toner image;

a first transfer mechanism that transfers the toner image on the first photoconductor to a surface of an image carrier moving in a first direction;

a first detection sensor that detects the toner image carried on the image carrier;

a second detection sensor that detects the toner image disposed to be separated in a second direction orthogonal to the first direction with respect to the first detection sensor and carried on the image carrier; and a controller that causes a second laser beam to be incident on the exposure component in response to a first test pattern and a second test pattern, forms an electrostatic latent image corresponding to the first test pattern on the first photoconductor and the second test pattern on a second photoconductor, forms a first toner image corresponding to the first test pattern by the first developing device and a second toner image corresponding to the second test pattern by a second developing device, transfers the first toner image of the first photoconductor to the image carrier by the first transfer mechanism and the second toner image of the second photoconductor to the image carrier by a second transfer mechanism, causes the image carrier to carry the toner images indicating the first test pattern and the second test pattern disposed to be separated from the first test pattern in the main scanning direction, determines a difference from a determination condition with respect to a first determination result based on a first threshold value at a first detection timing by the first detection sensor of the first test pattern and a second determination result based on the first threshold value at a second detection timing by the second detection sensor of the second test pattern, and discriminates a component to be an occurrence cause of the difference based on a combination of the first determination result and the second determination result when the difference is determined to be present, wherein the first test pattern and the second test pattern each include a linear first side that is formed in the main scanning direction and a linear second side that is formed in a diagonal direction with respect to the main scanning direction and is shorter than the linear first side in the main scanning direction, and the controller determines a difference from the determination condition with respect to a determination result based on a third threshold value for the linear first side and a determination result based on a fourth threshold value for the linear second side.

2. The image forming device according to claim 1, further comprising:

an output device that outputs information, wherein the controller causes information on the component to be the occurrence cause of the difference to be notified by the output device.

3. The image forming device according to claim 1, wherein the controller determines a difference from the determination condition with respect to a timing shift of the first detection timing and the second detection timing to the first threshold value.

4. The image forming device according to claim 1, wherein the first test pattern includes a plurality of first patterns, the second test pattern includes a plurality of second patterns, and the controller determines a difference from a number as the determination condition with respect to a first number of detections of the first pattern and a second number of detections of the second pattern, and discriminates a component to be the occurrence cause of the difference based on a combination of the first number of detections and the second number of detections when the difference is determined to be present.

5. The image forming device according to claim 1, wherein the controller controls the component discriminated to be the occurrence cause of the difference so that the difference is eliminated, and then causes the image carrier to carry the first test pattern and the second test pattern again, to determine the difference from the determination condition with respect to the first determination result and the second determination result.

6. The image forming device according to claim 1, wherein in case of a detection result that is detected for the linear first side and that is not detected for the linear second side, the controller controls the component discriminated to be the occurrence cause of the difference so that the difference is eliminated, and then causes the image carrier to carry the first test pattern and the second test pattern, and determines a difference from the determination condition with respect to the first determination result and the second determination result.

7. The image forming device according to claim 1, wherein:

the second photoconductor rotates about the main scanning direction as an axis;

the second developing device attaches a toner to a second electrostatic latent image of the second photoconductor to form the second toner image;

the second transfer mechanism transfers the second toner image on the second photoconductor to a surface of the image carrier moving in the first direction, the exposure component includes a first system that causes a laser beam to be incident on the first photoconductor in response to an image in the main scanning direction to form the first electrostatic latent image on the first photoconductor and a second system that causes a laser beam to be incident on the second photoconductor in response to the image in the main scanning direction to form the second electrostatic latent image on the second photoconductor, and the controller causes a laser beam to be incident to the exposure component in response to a third test pattern and a fourth test pattern, forms an electrostatic latent image corresponding to the third test pattern and the fourth test pattern on the second photoconductor, forms a third toner image corresponding to the third test pattern and a fourth toner image corresponding to the fourth test pattern by the second developing device, transfers the third toner image and the fourth toner image of the second photoconductor to the image carrier by the second transfer mechanism, and causes the image carrier to carry toner images indicating the third test pattern and the fourth test pattern disposed to be separated from the first test pattern in the main scanning direction, determines a difference from the determination condition with respect to a third determination result based on a second threshold value at a third detection timing by the first detection sensor of the third test pattern and a fourth determination result based on a fourth detection timing and the second threshold value by the second detection sensor of the fourth test pattern, and discriminates a component to be the occurrence cause of the difference based on a combination of the first determination result, the second determination result, the third determination result, and the fourth determination result.

8. The image forming device according to claim 1, wherein the controller discriminates a component to be the occurrence cause of the difference based on a combination of the first determination result and the second determination result that indicates any one of the first test pattern or the second test pattern is not detected.

9. The image forming device according to claim 1, wherein the toner comprises at least a cyan toner, a magenta toner, a yellow toner, or a black toner.

10. A method for an image forming device, comprising:

rotating a first photoconductor about a main scanning direction as an axis;

causing a first laser beam to be incident on the first photoconductor in the main scanning direction by an exposure component in response to an image and forming a first electrostatic latent image on the first photoconductor;

attaching toner to the first electrostatic latent image of the first photoconductor to form a toner image;

transferring the toner image on the first photoconductor to a surface of an image carrier moving in a first direction using a first transfer mechanism;

detecting the toner image carried on the image carrier using a first detection sensor;

detecting the toner image disposed to be separated in a second direction orthogonal to the first direction with respect to the first detection sensor and carried on the image carrier by a second detection sensor; and causing a second laser beam to be incident on the exposure component in response to a first test pattern and a second test pattern;

forming an electrostatic latent image corresponding to the first test pattern on the first photoconductor and the second test pattern on a second photoconductor;

forming a first toner image corresponding to the first test pattern by the first developing device and a second toner image corresponding to the second test pattern by a second developing device;

transferring the first toner image of the first photoconductor to the image carrier by the first transfer mechanism and the second toner image of the second photoconductor to the image carrier by a second transfer mechanism;

causing the image carrier to carry the toner images indicating the first test pattern and the second test pattern disposed to be separated from the first test pattern in the main scanning direction;

determining a difference from a determination condition with respect to a first determination result based on a first threshold value at a first detection timing by the first detection sensor of the first test pattern and a second determination result based on the first threshold value at a second detection timing by the second detection sensor of the second test pattern; and discriminating a component to be an occurrence cause of the difference based on a combination of the first determination result and the second determination result when the difference is determined to be present, wherein the first test pattern and the second test pattern each include a linear first side that is formed in the main scanning direction and a linear second side that is formed in a diagonal direction with respect to the main scanning direction and is shorter than the linear first side in the main scanning direction, and further comprising:

determining a difference from the determination condition with respect to a determination result based on a third threshold value for the linear first side and a determination result based on a fourth threshold value for the linear second side.

11. The method according to claim 10, further comprising:

outputting information by an output device; and causing information on the component to be the occurrence cause of the difference to be notified by the output device.

12. The method according to claim 10, further comprising:

determining a difference from the determination condition with respect to a timing shift of the first detection timing and the second detection timing to the first threshold value.

13. The method according to claim 10, wherein the first test pattern includes a plurality of first patterns, the second test pattern includes a plurality of second patterns, and further comprising:

determining a difference from a number as the determination condition with respect to a first number of detections of the first pattern and a second number of detections of the second pattern, and discriminating a component to be the occurrence cause of the difference based on a combination of the first number of detections and the second number of detections when the difference is determined to be present.

14. The method according to claim 10, further comprising:

controlling the component discriminated to be the occurrence cause of the difference so that the difference is eliminated, and then causing the image carrier to carry the first test pattern and the second test pattern again, to determine the difference from the determination condition with respect to the first determination result and the second determination result.

15. The method according to claim 10, further comprising:

in case of a detection result that is detected for the linear first side and that is not detected for the linear second side, controlling the component discriminated to be the occurrence cause of the difference so that the difference is eliminated, and then causing the image carrier to carry the first test pattern and the second test pattern, and determining a difference from the determination condition with respect to the first determination result and the second determination result.

16. The method according to claim 10, further comprising:

rotating the second photoconductor about the main scanning direction as an axis;

attaching a toner to a second electrostatic latent image of the second photoconductor to form the second toner image by the second developing device;

transferring the second toner image on the second photoconductor to a surface of the image carrier moving in the first direction by the second transfer mechanism, wherein the exposure component includes a first system that causes a laser beam to be incident on the first photoconductor in response to an image in the main scanning direction to form the first electrostatic latent image on the first photoconductor and a second system that causes a laser beam to be incident on the second photoconductor in response to the image in the main scanning direction to form the second electrostatic latent image on the second photoconductor;

causing a laser beam to be incident to the exposure component in response to a third test pattern and a fourth test pattern;

forming an electrostatic latent image corresponding to the third test pattern and the fourth test pattern on the second photoconductor;

forming a third toner image corresponding to the third test pattern and a fourth toner image corresponding to the fourth test pattern by the second developing device;

transferring the third toner image and the fourth toner image of the second photoconductor to the image carrier by the second transfer mechanism;

causing the image carrier to carry toner images indicating the third test pattern and the fourth test pattern disposed to be separated from the first test pattern in the main scanning direction;

determining a difference from the determination condition with respect to a third determination result based on a second threshold value at a third detection timing by the first detection sensor of the third test pattern and a fourth determination result based on a fourth detection timing and the second threshold value by the second detection sensor of the fourth test pattern; and discriminating a component to be the occurrence cause of the difference based on a combination of the first determination result, the second determination result, the third determination result, and the fourth determination result.

17. The method according to claim 10, further comprising:

discriminating a component to be the occurrence cause of the difference based on a combination of the first determination result and the second determination result that indicates any one of the first test pattern or the second test pattern is not detected.

18. The method according to claim 10, wherein the toner comprises at least a cyan toner, a magenta toner, a yellow toner, or a black toner.

* * * * *